United States Patent [19]

Nuti

[11] Patent Number: 5,036,818

[45] Date of Patent: Aug. 6, 1991

[54] APPARATUS FOR REGULATING THE INFLOW OF FUEL INTO THE INTAKE DUCT OF AN INTERNAL COMBUSTION ENGINE

[75] Inventor: Marco Nuti, Pisa, Italy

[73] Assignee: Piaggio Veicoli Europei S.p.A., Italy

[21] Appl. No.: 493,645

[22] Filed: Mar. 15, 1990

[30] Foreign Application Priority Data

Apr. 24, 1989 [IT] Italy ..... 20266 A/89

[51] Int. Cl.[5] ..... F02D 7/00; F02M 7/00

[52] U.S. Cl. ..... 123/399; 123/445

[58] Field of Search ..... 123/399, 478, 479, 480, 123/445, 472, 400; 261/75, 76, 78.1, 119.2, 50 A, 69 R

[56] References Cited

U.S. PATENT DOCUMENTS

| | | | |
|---|---|---|---|
| 4,307,692 | 12/1981 | Fiala | 123/445 |
| 4,409,944 | 10/1983 | Schmidt | 123/445 |
| 4,424,785 | 1/1984 | Ishida et al. | 123/479 |
| 4,561,405 | 12/1985 | Simons | 123/478 |
| 4,703,743 | 11/1987 | Takayama | 123/478 |
| 4,771,752 | 9/1988 | Nishimura et al. | 123/489 |
| 4,796,579 | 1/1989 | Wolfe et al. | 123/399 |
| 4,799,467 | 1/1989 | Ishikawa et al. | 123/399 |
| 4,887,577 | 12/1989 | Arai et al. | 123/478 |
| 4,895,122 | 1/1990 | Naguchi et al | 123/489 |
| 4,898,138 | 2/1990 | Nishimura et al. | 123/399 |
| 4,909,217 | 3/1990 | Takahashi et al. | 123/399 |

*Primary Examiner*—Raymond A. Nelli

*Attorney, Agent, or Firm*—Diller, Ramik & Wight

[57] ABSTRACT

An apparatus is provided for regulating the inflow of fuel into an intake duct (19) of a controlled-ignition internal combustion engine through the utilization of a fuel injection valve (11) having an outlet (21) opening into the intake duct (19) downstream of a multiple position speed regulator valve (30). Conventional control mechanisms (29, 40) energize the fuel injection valve (11) as a function of the operating parameters of an associated engine. A fuel container (13) has an outlet connected by a pipe (12) to an inlet of the fuel injection valve (11), and a float valve mechanism (17) maintains a substantial uniform level of fuel (14) in the fuel container (13) which corresponds to the position of the fuel injection valve outlet (21) whereby the amount of fuel introduced into the intake duct (19) is proportional to the velocity of the air flowing therethrough and substantially absent pressurization from the fuel (14) within the fuel container (13).

7 Claims, 1 Drawing Sheet

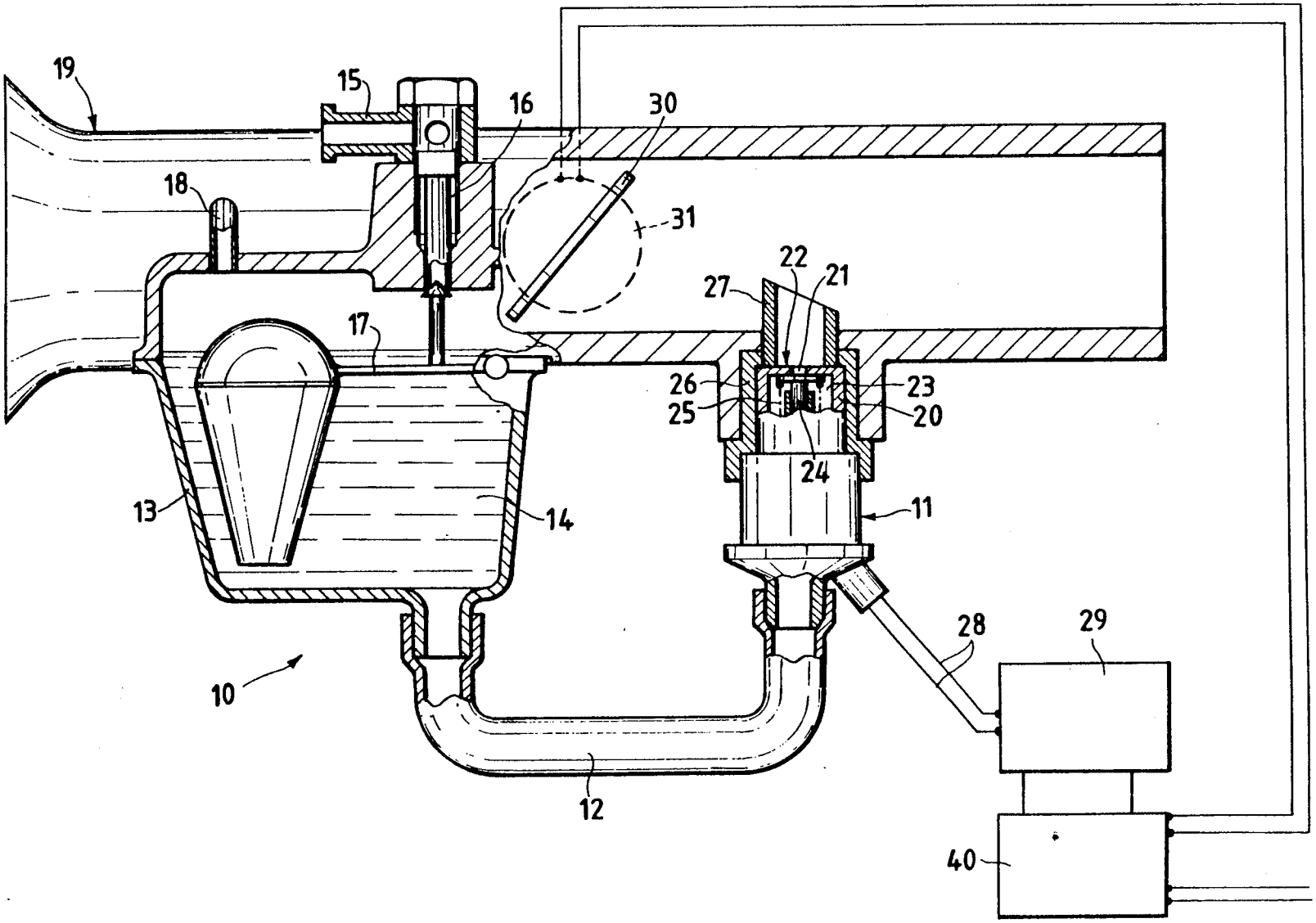
10
11
12
13
14
15
16
17
18
19
20
21
22
23
24
25
26
27
28
29
30
31
40

APPARATUS FOR REGULATING THE INFLOW OF FUEL INTO THE INTAKE DUCT OF AN INTERNAL COMBUSTION ENGINE

BACKGROUND OF THE INVENTION

The present invention relates to an apparatus for regulating the inflow of fuel into an intake duct of an internal combustion engine.

In order to overcome well-known problems associated with conventional carburetor systems, electronically controlled systems for injecting fuel into intake ducts of internal combustion engines were developed in the past. These systems are structurally simple because the injectors can be fed under relatively low pressure. The use of such electronically controlled fuel injectors has expanded, particularly with respect to four-stroke engine applications because of the ability to vary the injection timing and the injection duration. While these characteristics are advantageous relative to four-stroke engines, they are far less advantageous relative to two-stroke internal combustion engines. As a matter of fact, in two-stroke engines, problems arise from the nature of the diagram of distribution of the operating strokes, and these problems persist both in indirect fuel injection systems and carburetor fuel systems. However, at least with the indirect fuel injection systems, one can meter and maintain relatively perfectly constant air-to-gas/fuel ratios which in carburetor systems tends to change in the direction of enrichment of the air/fuel admixture as engine revolution speed increases.

While one might consider utilizing electronic fuel injection systems with two-stroke engines, particularly because of the advantages of varying the injection timing and the injection duration, the peculiarity of two-stroke engines makes this less desirable than one might initially appreciate. For example, though the value of injected fuel per each engine revolution would be optimum immediately upon the engine leaving the production line, in very short operating time thereafter this optimum level of performance deteriorates due to normal wear in the fuel passages, changes in clearances, etc. which during the life of the engine alters the amount of intake air per each engine revolution.

SUMMARY OF THE INVENTION

The purpose of the present invention is to provide an apparatus for regulating the inflow of fuel for internal combustion engines which automatically adjust the air/fuel admixture as such changes occur independently of the algorithm of the control mechanism which controls the time and duration of the actuation of such conventional fuel injection valves.

The purpose of the present invention is achieved through an apparatus which includes an intake duct into which opens an outlet of a fuel injection valve at a point downstream of a multiple position speed regulator valve. Control means are provided for selectively energizing the fuel injection valve as a function of operating parameters of an associated engine. A fuel container having an outlet is connected by a pipe to an inlet of the fuel injection valve. Means are provided for maintaining a substantial uniform level of fuel in the fuel container, and the latter level corresponds to the position of the fuel injection valve outlet, whereby the amount of fuel introduced into the intake duct is proportional to the velocity of air flowing through the intake duct and substantially absent pressurization from the fuel within the fuel container. In this fashion, the suction established in the intake duct during the intake stroke of the internal combustion engine effects an automatic correction of the air/fuel admixture.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

The drawing is a side elevational view with parts broken away for clarity of the apparatus of the invention, and illustrates an intake duct, a fuel container and a fuel injection valve having an outlet opening into the intake duct at a position corresponding to the level of fuel in the fuel container.

DESCRIPTION OF THE PREFERRED EMBODIMENT

A novel apparatus for regulating the inflow of fuel into an intake duct of a controlled-ignition internal combustion engine is illustrated in the drawing and is generally designated by the reference numeral 10.

The apparatus 10 includes at least one solenoid operated fuel injection valve 11 having an inlet (unnumbered) connected by a pipe 12 to an outlet (also unnumbered) of a fuel cup or fuel container 13 which contains fuel 14 having a substantially uniform/constant upper level (unnumbered). The fuel is fed into the fuel container 13 through external duct 15 carrying a conventional valve 16 which is controlled by means, generally designated by the reference numeral 17, for maintaining the substantial uniform level of the fuel 14 in the fuel container 13. The fuel level maintaining means 17 includes a float (unnumbered) connected to an arm (unnumbered) pivoted to the fuel container 13 and having a valve head (unnumbered) which normally seats against a valve seat (unnumbered) of the valve 16, as is readily apparent in the drawing. Should the float valve descend, fuel is automatically introduced through the valve 16 into the fuel container 13 to maintain the level of the fuel in the fuel container 13 at the height generally illustrated in the drawing. The interior of the fuel container 13 is in fluid communication via a duct 18 with the interior of the intake duct 19 at a point upstream from a speed governor/throttle valve 30.

The fuel injector or fuel injector valve 11 includes a body 20 having a bore 21 formed at the center of a circular end surface or wall 22. It is through the bore 21 that the fuel contained inside an inner cylindrical chamber 23 of the fuel injector 11 flows into the intake duct 19 when a movable core 24 is drawn downwardly from the position shown in the drawing. The movable core 24 is normally maintained in the position illustrated in the drawing closing the bore 21 by a spring 25. However, an electromagnetic core (not shown) is energized over leads 28 to draw the core 24 downwardly against the bias of the spring 25 to open the bore 21 as circumstances dictate. The body 20 of the fuel injector 11 is positioned laterally relative to the body of the intake duct 19 by means of a centering sleeve 26 which includes a diffuser 27. The diffuser 27 is provided with an inclined outlet surface (unnumbered) which augments the outflowing of the fuel from the inner cylindrical chamber 23 through the bore 21 and into the intake duct 19 and the consequent mixing thereof with the airstream flowing through the intake duct 19. The fuel injection valve and specifically the bore 21 thereof is positioned substantially at the same level as the level of the fuel 14 in the fuel container 13. In this manner, the fuel introduced into the intake duct 19 upon the opening of the bore 21 is proportional to the velocity of the air flowing through the intake duct 19 and is achieved substantially absent any other pressurization, particularly substantially absent pressurization from the unpressurized fuel within the fuel container 13.

The two leads 28 of the fuel injector 11 are connected to a pilot circuit 29 which controls the time of excitation and the duration of excitation of the coil (not shown) of the fuel injection valve 11 which is a function of a control algorithm implemented by a conventional electronic control unit 40. The control algorithm is responsive to signals coming from a transducer 31 which senses the position of the speed governor or throttle valve 30, as well as from a transducer (not shown) which senses the RPM's of the internal combustion engine.

The amount of fuel which is to be fed at each revolution into the intake duct 19 is preliminarily determined at design and manufacture of the engine, and all such values are stored in the electronic memory of the conventional control unit 40. In accordance with the present invention, an automatic correction is obtained relative to the amount of fuel which is fed through the bore 21 into the intake duct 19 and therein admixed with the flowing air stream. This automatic correction is due to the fact that the amount of fuel which leaves the bore 21 varies with the volume of air drawn in during the intake stroke of the internal combustion engine. (Assuming that the time intervals of opening of the fuel injector 11 are constant.) The fuel from the fuel container 13 is not fed through the intake duct 19 under pressure or through a constant-pressure feed system or any type of pressure feed system, as is conventional in such fuel injection systems, but instead is drawn into the intake duct 19 due to the de-pressure/ suction which is established inside the intake duct 19 and specifically the diffuser 27 during the intake stroke of the thermodynamic cycle of the internal combustion engine.

Because of the virtually negligible difference between the level of fuel inside the fuel container 13 and the position of the outlet bore 21 of the fuel injector 11, there is virtually no pressure acting upon the fuel 14 in the fuel container 13. Therefore, the amount of fuel which is drawn into the intake duct 19 is not pressure dependent but depends, other than the time the bore 21 is open, upon the suction generated in the intake duct 19 which is analogous to that which occurs in so-called aspirated engines.

The advantages of the injection apparatus of the present invention just described, as compared to traditional injection systems, is that the fuel mixture is proportional to the depressure/ suction which is generated inside the intake duct 19. Inasmuch as the latter is directly proportional to the intake air volume of the intake stroke of the internal combustion engine, it, obviously, occurs that the mixing ratio of fuel to air remains unchanged even though the amount of air taken in per engine revolution may vary. In this manner an automatic correction of the amount of fuel/air admixture is obtained with the RPM's of the engine and the opening of the throttle valve 30 being the same. This self-correction compensates for changes in the amount of air taken into the engine due to unforeseeable and nondeterminable operating parameters, wear, changes in clearance, etc. Thus, a major advantage is achieved by the invention, namely, metering the amount of injected fuel as a function of the speed of revolution of the engine and the position of the throttle valve in the absence of further monitoring, although monitoring further operating parameters falls within the scope of the present invention.

It should also be noted that due to the present invention, one need not measure the flow rate of air intaken by the engine which is another, but more expensive, approach to solving the problem addressed herein. However, such monitoring would be difficult with respect to single-cylinder engines because of the high pulsation of the flow rate of the intake air stream. In the case of a single cylinder, two-stroke engine, one would have to dampen such flow rate, pulsations or oscillations, and this can be improbable if not itself impossible owing to the considerable decrease in volumetric efficiency which would be caused thereby.

Although a preferred embodiment of the invention has been specifically illustrated and described herein, it is to be understood stood that minor variations may be made in the apparatus without departing from the spirit and scope of the invention, as defined appended claims.

I claim:

1. Apparatus for regulating the inflow of fuel into an intake duct of a controlled-ignition internal combustion engine comprising an intake duct having upstream and down stream ends, a fuel injection valve having an outlet opening into said intake duct downstream of a multiple position speed regulator valve, control means for selectively energizing said fuel injection valve as a function of current values of operating parameters of an associated engine, a fuel container, a pipe connecting an outlet of said fuel container with an inlet of said fuel injection valve, means for introducing fuel into said fuel container, means for maintaining a substantially uniform level of fuel in said fuel container, and said fuel injection valve outlet being positioned substantially at the substantially uniform level of fuel in said fuel container whereby the amount of fuel introduced into said intake duct is proportional to the velocity of the air flowing through said intake duct and substantially absent pressurization from the fuel within said fuel container.

2. The apparatus as defined in claim 1 wherein said control means regulates the time period said fuel injection valve is energized as a function of the RPM's of an associated engine.

3. The apparatus as defined in claim 1 wherein said control means regulates the time period said fuel injection valve is energized as a function of the position of said speed regulator valve.

4. The apparatus as defined in claim 1 wherein said control means regulates the time period said fuel injection valve is energized as a function of the RPM's of an associated engine and the position of said speed regulator valve.

5. The apparatus as defined in claim 1 wherein said fuel level maintaining means includes a float in said fuel container, and a valve controlled by said float for selectively introducing fuel into said fuel container in response to a decline in the substantially uniform level of fuel in said fuel container.

6. The apparatus as defined in claim 1 wherein said fuel injection valve includes a diffuser having an inclined wall disposed in said intake duct.

7. The apparatus as defined in claim 1 including conduit means for connecting a chamber above the fuel in the fuel container with said intake duct upstream of said speed regulator valve.

* * * * *